United States Patent [19]

Hanaoka et al.

[11] 4,450,659

[45] May 29, 1984

[54] HORIZONTAL FORCE RESISTING BUILDING STRUCTURE AND ATTACHMENT FOR ATTACHING WALLS TO SAME

[75] Inventors: Tadashi Hanaoka, Kawasaki; Hiroaki Umezu, Tokyo; Ginichi Shigaraki, Fujisawa, all of Japan

[73] Assignee: Misawa Homes K.K., Japan

[21] Appl. No.: 275,158

[22] Filed: Jun. 19, 1981

[51] Int. Cl.[3] ..... E04B 1/98; E04H 9/02

[52] U.S. Cl. ..... 52/167; 52/235; 52/401

[58] Field of Search ..... 52/167, 235, 401, 487

[56] References Cited

U.S. PATENT DOCUMENTS

| | | | |
|---|---|---|---|
| 2,053,226 | 9/1936 | Ruge | 52/167 |
| 2,865,476 | 12/1958 | Schooler | 52/487 |
| 2,994,415 | 10/1961 | Halle | 52/487 |
| 3,736,712 | 6/1973 | Mato | 52/167 |
| 3,755,980 | 9/1973 | Weidlinger | 52/235 |
| 3,834,099 | 9/1974 | Haeussler | 52/235 |
| 3,998,016 | 12/1976 | Ting | 52/235 |
| 4,009,549 | 3/1977 | Hala | 52/235 |
| 4,073,107 | 2/1978 | Rousseau | 52/167 |

FOREIGN PATENT DOCUMENTS

| | | | |
|---|---|---|---|
| 156479 | 11/1904 | Fed. Rep. of Germany | 52/401 |
| 2308746 | 12/1976 | France | 52/487 |
| 1113727 | 5/1968 | United Kingdom | 52/401 |
| 0619605 | 7/1978 | U.S.S.R. | 52/167 |
| 0706504 | 1/1980 | U.S.S.R. | 52/167 |

*Primary Examiner*—R. P. Machado
*Assistant Examiner*—Alvin Chin-Shue
*Attorney, Agent, or Firm*—Kane, Dalsimer, Kane, Sullivan and Kurucz

[57] ABSTRACT

A horizontal force resisting building structure having a steel building framework, a bearing wall member being placed outside the building framework so as to face a suitable structure plane of the framework, and an attachment for attaching the wall member to the framework. The attachment has less resistance to plastic deformation than the wall member, and may include a bracket and a connector for connecting the bracket to the wall member.

7 Claims, 13 Drawing Figures

HORIZONTAL FORCE RESISTING BUILDING STRUCTURE AND ATTACHMENT FOR ATTACHING WALLS TO SAME

BACKGROUND OF THE INVENTION

This invention relates to a building structure which can resist horizontal forces applied by earthquakes, strong wind and the like and an attachment for attaching walls to such structure.

Conventionally, buildings of steel frame construction have adopted Rahmen structures or bracing structures or mixed structures thereof for resisting horizontal forces exerted by earthquakes, strong wind, etc. Such steel frame constructions have an advantage of avoiding by high resistance of steel materials collapse of the building due to brittle fracture against heavy earthquakes. This is because the steel frame works are capable of making by deflection of the columns large relative story displacement or large floor beam displacement between adjacent floors according to a horizontal force applied. However, the steel frame constructions have disadvantages such as cracking or damage of curtain walls and partitions which are nonbearing materials and attached to the structure planes thereof, breaking of joints and caulkings, and separation of finish materials.

On the other hand, the building construction using bearing wall structures has a higher rigidity than that of the steel frame, providing an advantage of minimizing story displacement thereof caused by light to moderate earthquakes. However, the bearing wall structures have a disadvantage that wall strength thereof must be extremely large against heavy earthquakes because when an earthquake occurs an increased horizontal force, i.e., story-shearing force according to the larger rigidity of the bearing wall structure is applied to the wall. Thus, the heavy-earthquake-resisting buildings having bearing wall structures are uneconomical.

SUMMARY OF THE INVENTION

Accordingly, one object of the invention is to provide a horizontal force resisting building structure which is capable of eliminating the disadvantages of the buildings using steel frame construction which are given by story displacement thereof due to light to moderate earthquakes.

Another object of the invention is to provide a horizontal force resisting building structure which can minimize damage to the wall members or at least reduce the possibility of the building being seriously damaged or collapsing due to brittle fracture of the wall members when heavy earthquakes take place.

A further object of the invention is to provide an attachment for attaching a wall member to a horizontal force resisting building framework, the attachment being capable of taking largely seismic loads transmitted from the building framework to thereby minimize damage to the wall member caused by heavy earthquakes and the like.

Other objects and advantages of this invention will appear in the description and claims which follow taken together with the appended drawings.

In one aspect of the invention, there is provided a horizontal force resisting building structure comprising: a steel building framework; a bearing wall member being placed outside the building framework so as to face a structure plane of the framework; and an attachment for attaching the wall member to the framework, the attachment having less resistance to plastic deformation than the wall member.

In another aspect of the invention, there is provided an attachment for attaching a bearing wall member to a horizontal force resisting building, the attachment having less resistance to plastic deformation than the wall member, and comprising a bracket and means for connecting the bracket to the wall member.

BRIEF DESCRIPTION OF THE DRAWING

While the specification concludes with the claims which particularly point out and distinctly define the subject matter which is regarded as the invention, it is believed that the invention will be more clearly understood when considering the following detailed description and the accompanying FIGURES of the drawings in which:

DETAILED DESCRIPTION OF THE INVENTION

Figure 1:
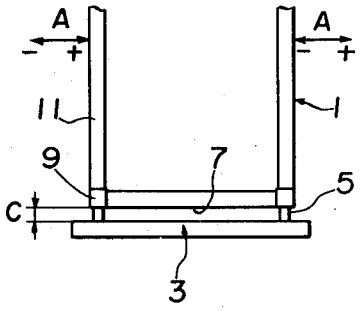
FIG. 1 is a diagrammatical plan view illustrating part of a modular building unit with a lateral force rsisting building structure according to the present invention.
Figure 2:
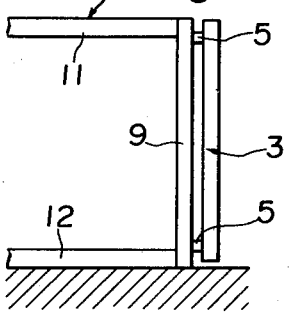
FIG. 2 is a side view of the modular building unit shown in FIG. 1.

With reference to FIGS. 1 and 2, there is illustrated a modular building unit which utilizes a building structure according to the present invention. This building structure generally comprises a steel framework 1 of a rectangular parallelepiped shape, a bearing wall member 3 and four attachments 5, three of which are shown. The attachments connect the four corners of the wall member to the steel framework so that the wall member is disposed outside the framework to face an appropriate one of the structural planes, a smaller lateral side 7 in this embodiment.

The steel framework 1 of which only vertical columns 9 and girders 11 are illustrated may incorporates Rahmen structures or bracing structures or a combination of both.

The wall member 3 has such a rigidity as to sufficiently resist by itself horizontal forces or story-shearing forces in a direction shown by an arrow A without any substantial extra cost which forces will be applied to the wall member when a light or moderate earthquake occurs. The wall member may have an appropriate shape and dimensions corresponding to the structure plane 7 of the steel framework 1. In this embodiment the wall member 3 is a square plate. Furthermore, the wall member 3 may be constructed of conventional materials and have structures, e.g., reinforced autoclaved lightweight concrete panel. The number of the above walls secured to the framework may be more than one.

The attachment 5 has at least such a strength as to transmit horizontal forces which are applied to the steel framework 1 by light or moderate earthquakes or strong wind to the wall member 3 having a larger rigidity so that the wall member may resist the forces for reducing story deformation of the framework. The attachment 5 is furthermore designed to be plastically deformed before the wall member reaches a limit where plastic failure or fracture of the wall member takes place. The clearence C between the steel framework 1 and the wall member 3 is determined to avoid fracture or damage of the wall member due to interference or collision with each other when the steel framework is subjected to large story deformation caused by heavy earthquakes, extraordinary typhoons, etc. The number of the attachments may be more than four.

Figure 3:
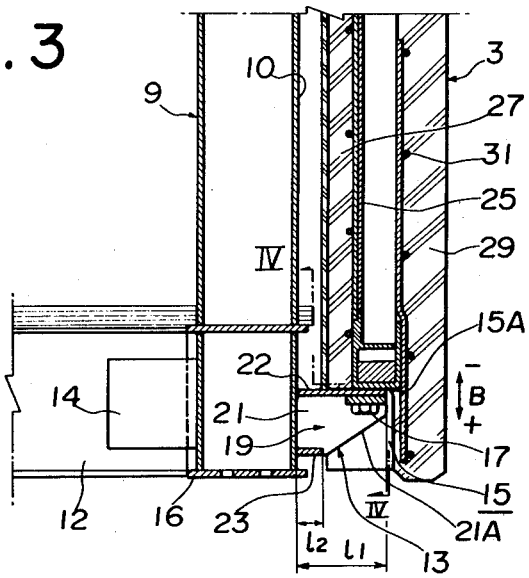
FIG. 3 is an enlarged vertical section of a structure attaching the wall bottom to the column of the modular unit in FIGS. 1 and 2.
Figure 4:
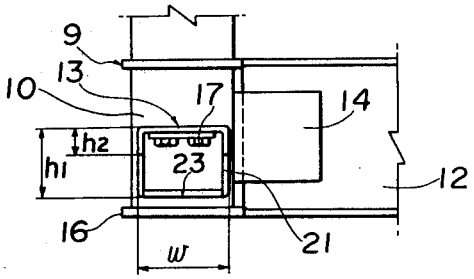
FIG. 4 is a view of the attaching structure in FIG. 3 taken along the line IV—IV.

Referring to FIGS. 3 to 4, the attachment 5 for the wall bottom may comprise a bracket 13, a recess 15 formed in the one of the inner bottom corners of the wall member 3, and a pair of bolts 17 for detachably fastening the bracket to the upper wall 15A of the recess 15. The bracket 13 has a channel member 19 the proximal end of which is firmly attached by welding and the like to one face 10 of the square tubular column 9 having two parallel through diaphragms 16, with its flanges 21 directed downwards. The flanges 21 are cut slantingly at 21A. The edges of the flanges are firmly connected to the opposite ends of a rectangular stiffener plate 23 by welding as the like. The web 22 of the channel member 19 is detachably attached at its free end to the steel structural core 25 of the wall member by a pair of bolts 17 as a connecting means. 27, 29, and 31 represent inner and outer wall skins of autoclaved lightweight concrete, and wire mesh, respectively.

Figure 5:
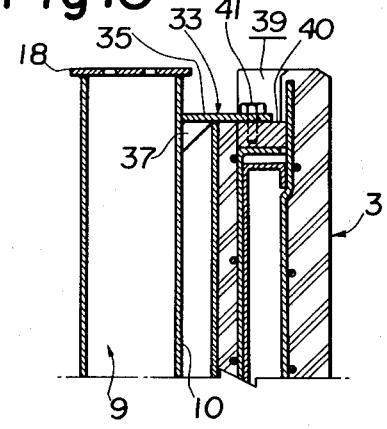
FIG. 5 is an enlarged vertical section of a structure attaching the wall top to the column of the modular unit in FIGS. 1 and 2.
Figure 6:
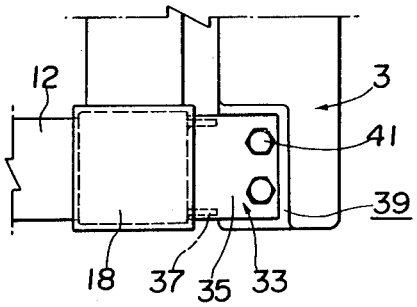
FIG. 6 is a plan view of the attaching structure in FIG. 5.

An attachment for the top of the wall member 3 is illustrated in FIGS. 5 and 6. This attachment includes a bracket 33 which has a rectangular seat plate 35 firmly attached at the proximal end thereof to one face 10 of a tubular column 9 by welding and the like and a pair of trigonal stiffeners 37 which support both side edges of the seat plate 35. The seat plate is detachably fastened at its free end to the floor 40 of a recess 39 formed in a corner of the wall top by a pair of bolts 41.

In both embodiments in FIGS. 3 to 6, the brackets 13 and 33 are of steel and have each a smaller upper yield point than the wall member 3.

When a light or moderate earthquake occurs, a story-shearing force in the direction A (FIG. 1) is applied to the steel framework 1, which is liable to be subjected to some story deformation. However, the shearing force is transmitted to the wall member 3 through the four brackets 13 and 33 because of their sufficient rigidity. The wall member 3 resists the horizontal force produced by the earthquake and is subjected to slight deformation and the relative positions of the four brackets 13 and 33 do not largely change. Thus, the wall member 3 reduces story deformation of the framework 1 by taking largely the lateral forces applied by the earthquake, and further can reduce the amplitude of oscillation of the building to thereby prevent damage to the nonbearing materials incorporated therein, such as cracking of curtain walls and breaking of joints and caulkings.

On the other hand, when a heavy earthquake takes place, the wall member cannot maintain its rigidity by itself, but the possibility of the wall member being broken or falling from the building framework is greatly reduced because the brackets 13 and 33 which have each a smaller upper yield point than the wall member are plastically deformed earlier than the wall member 3. The wall which is kept at an appropriate distance from the steel framework can furthermore avoid interference with or collision against the framework. Thus, the story-shearing force to be transmitted to the wall is largely taken or absorbed by the brackets 13 and 33 and a small proportion of the force is transmitted from the framework to the wall, which can therefore avoid brittle fracture. In this event, the story-shearing force is largely taken by the steel framework 1. The framework toughly resists the heavy earthquake, so that the possibility of collapse or serious damage of the building due to brittle fracture of the walls is eliminated or at least minimized.

Figure 8:
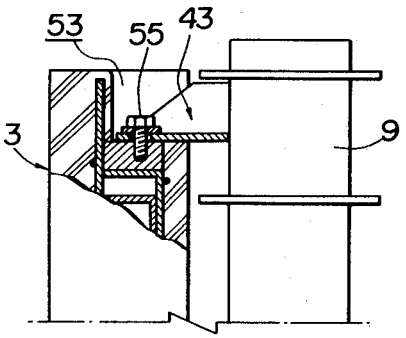
FIG. 8 is a side view, partially in section, of the attaching structure in FIG. 7.
Figure 7:
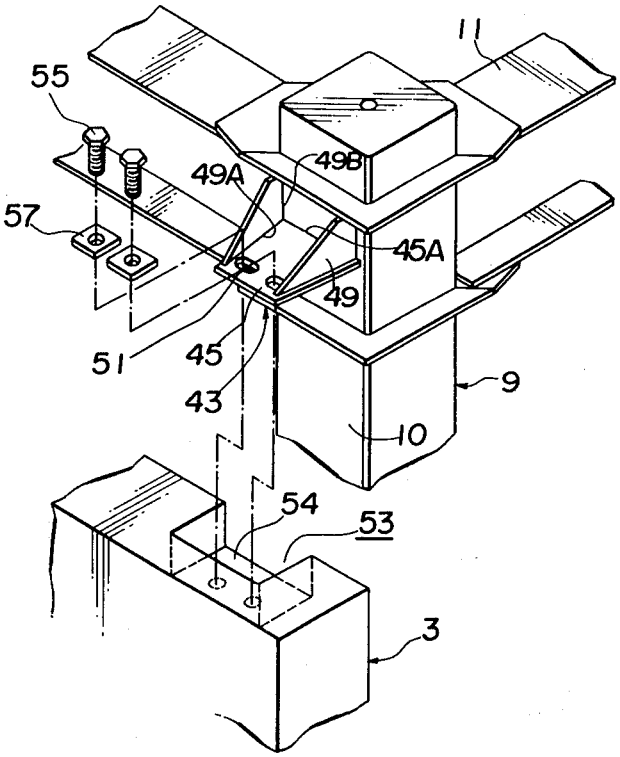
FIG. 7 is an enlarged perspective view of components used for an alternative form of the structure attaching the wall top to the column of the modular unit in FIGS. 1 and 2.

In FIGS. 7 to 8, there is illustrated an alternative form of the attachment for the top portion of the wall member. This attachment includes a steel bracket 43 having a seat plate 45 of a trapezoidal shape which is firmly secured by welding and the like at its longer base 45A to one face 10 of the top portion of a square tubular column 9 and which projects perpendicularly therefrom. A pair of parallel trapezoidal stiffeners 49 are fixedly attached at their lower or longer bases 49A to the peripheries of both sides of the seat plate 45, and at their upright sides 49B to the face 10 of the column by welding and the like. This bracket 43 has also a smaller upper yield point than the wall member 3. In the seat plate 45 two slots 51 extending in parallel with the structural plane of the framework 9 are formed along the base 45A for adjusting the wall position with respect to the columns. The bolt 55 fitted in a washer 57 as a connecting means passes through the slot and engages with a wall core in the recess 53 formed in a top edge corner of the wall 3 to thereby connect the seat plate 45 to the bottom 54 of the recess. It will be easily understood that the above bracket 43 can also be used for connecting the bottom portion of the wall member 3 to the column 9, in which case the bracket is attached to one face 10 of the column upside down and is connected by bolts, rivets, etc. to a recess formed in the bottom portion of the wall member 3 as in FIG. 3.

Figure 9:
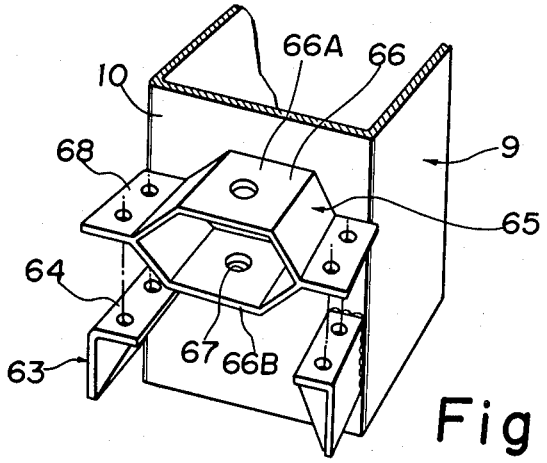
FIG. 9 is a perspective view of components used for an alternative form of the structure attaching the wall bottom to the column of the modular unit in FIGS. 1 and 2.
Figure 10:
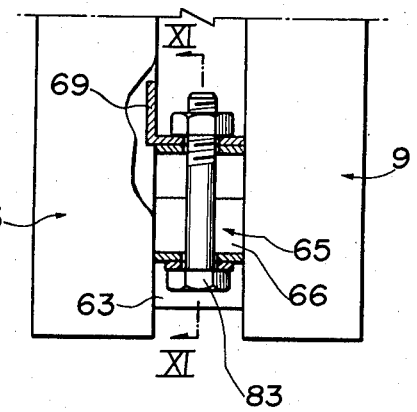
FIG. 10 is a side view, partially in section, of the attaching structure in FIG. 9.
Figure 11:
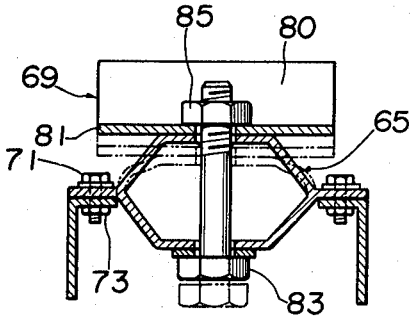
FIG. 11 is a sectional view of the attaching structure in FIG. 10 taken along the line XI—XI.

Another alternative form of the attachment 5 for the bottom portion of the wall member 3 is illustrated in FIGS. 9 through 11. This attachment comprises a steal angle member 69 and a bracket having a pair of seat members 63 and a spring member 65 of spring steel. Each seat member 63 is of a steel angle and is fixedly attached at its lateral edge to one face 10 of the column bottom so that one leg 64 is positioned on the same level as the one leg of the seat member. The spring member 65 has a body portion 66 shaped generally like a hollow hexagonal prism with equal and parallel retangular planes 66A and 66B and a pair of end plates 68 formed integrally with and projecting outwards from the outer corners faced away from each other of the body portion 66. The spring member 65 is detachably connected at its end plates 68 to seat plates or legs 64 of the seat member 63 by bolts 71 and nuts 73 as shown in FIG. 11. The angle member 69 is firmly attached at one leg 80 to the bottom portion of the wall member 3 by welding, rivets, etc. The other leg 81 is detachably fastened onto the body portion 66 by a bolt 83 passing through center holes 67 formed therein and a nut 85. While this attachment is used for the bottom portion of the wall to the column, it can also be used for connection of the wall top portion. The bracket in this embodiment has also a smaller upper yield point than the wall member 3.

The spring member 65 can absorb some energy of preliminary tremors of light to moderate earthquakes by deforming the spring body 66 as shown by a dot and dash line in FIG. 11. The spring body 66 can return back to its original shape by elasticity. When a heavy earthquake occurs, the whole attachment plastically deformes rather than the spring member only. It will be clearly understood that this attachment can also be used for attaching the wall tops to the columns.

EXAMPLES: A two-story building consisting of two vertically-stacked modular building units was prepared and tested. The unit for the first floor had dimensions of 2580 mm by 4540 mm by 2275 mm. The unit for the second floor had dimensions of 880 mm by 4540 mm by 2275 mm, of which height was smaller than one for practical use for the convenience of the test, but was enough for the test of the building structure according to the present invention. The steel framework of each unit was constructed by welding four square tubular steel columns 9 (125 mm×125 mm×3.2 mm) and four lower wide flange steel beams 12 (150 mm×100 mm×3.2 mm×4.5 mm) through connecting strips 14 (4.5 mm×90 mm×90 mm) as shown in FIG. 3 and had generally the same structure as the framework 1 shown in FIGS. 1 and 2, but had no upper beams 11. The second floor framework was stacked on the first floor framework by connecting a through diaphragm 16 (6 mm×141 mm×141 mm) of the bottom end of each second floor column to a through diaphragm 18, which has the same dimensions as the diaphragm 16, of the top end of the corresponding first floor column by three high-strength bolts and one guide pin. The adjacent columns of larger lateral faces of each unit framework were strengthened by cross braces each having a diameter of 13 mm. As the bearing wall, a PALC panel (the product manufactured by Misawa Home Kabushiki Kaisha, Japan) which is a sort of reinforced autoclaved lightweight concrete panels was used. The wall panels had each dimensions of 2580 mm by 2265 mm by 120 mm and was attached at its four corner portions to each of the smaller lateral faces of each framework by brackets. The top corners of each wall were connected to the column tops by steel brackets which were the type as illustrated in FIG. 5, but the brackets or seat plates had no supporting stiffeners 37 and were inserted and secured between the bottom diaphragms 16 of the second floor columns and top diaphragms 18 of the first floor columns connected and between the top through diaphragms 18 of the second floor columns and the roof panel connected thereto, respectively. The seat plates had each dimensions of 4.5 mm by 125 mm by 205 mm and projected outwards from the diaphragm edges by 80 mm. The connecting structure of the wall bottoms to the columns was as shown in FIGS. 3 and 4. Each of the brackets 13 had a thickness of 4.5 mm and further had the following dimensions:

| | | |
|---|---|---|
| $h_1$ = 65 mm, | $h_2$ = 25 mm, | $l_1$ = 80 mm, |
| $l_2$ = 25 mm, | w = 115 mm | |

The stiffeness 23 had each a demensions of 4.5 mm by 106 mm by 25 mm. Each clearance C between the columns and the wall panels was 25 mm. As the roof panel, a reinforced PALC panel having dimensions of 4540 mm by 2275 mm by 120 mm was used. A particle board having a thickness of 20 mm was used as the floor panel and was fastened by nails to the nine rectangular wool floor joists (153 mm×40 mm) spanned between the longer beams 12 of each floor. For the second floor, a plaster board having a thickness of 7 mm was provided as a lower material between the particle board and the floor joists.

The mechanical properties of test specimens of the steel materials and the PALC materials adopted for the components used are tabulated below. (mean values are given)

| | Yield stress (upper) $\sigma_y$(metric ton/cm$^2$) | Tensile stress $\sigma_u$(metric ton/cm$^2$) | Coefficient of extension (%) |
|---|---|---|---|
| Square tubular column | 3.82 | 4.97 | 40 |
| Wide flange beam (flange) | 3.18 | 4.77 | 65 |
| (web) | 3.31 | 5.08 | 41 |
| Through diaphragm | 3.17 | 4.47 | 39 |
| Bracket (JIS:SS41) | 2.71 | 3.83 | 34 |
| Connecting strip | 2.82 | 4.66 | 34 |

| | Compresion Test Specific gravity | Compresion Test $F_c$(kg/cm$^2$) | Cleavage Test Specific gravity | Cleavage Test $F_k$(kg/cm$^2$) |
|---|---|---|---|---|
| PALC wall panel and roof panel | 0.511 | 39.8 | 0.509 | 6.4 |

(The above specific gravity is absolute dry specific gravity.)

The four first-floor columns were fixed to a reaction base, and alternative positive and negative horizontal forces (static loads) as shown by arrows A in FIG. 1 were applied parpendicularly to the center portions of the longer edges of the PALC roof panel. The horizontal forces were gradually increased from 2 to 16 metric tons by adding one metric ton after each hysteresis cycle. In addition, steel materials of 1000 kg of 2000 kg were placed as vertical compensating loads on the second floor and the roof panel, respectively, but the latter load was reduced to 1000 kg after the lateral force applied to the building reached 13 metric tons. The following results were obtained:

| | |
|---|---|
| Proportional limit | ±7.0 metric tons |
| Horizontal displacement of the longer edges of the roof panel at the proportional limit | 6 mm |
| Maximum strength | +16.0 metric ton |
| Horizontal displacement of the longer roof edges at the maximum strength | 77 mm |
| Maximum horizontal displacement of the longer roof edges | 78 mm |

Figure 12:
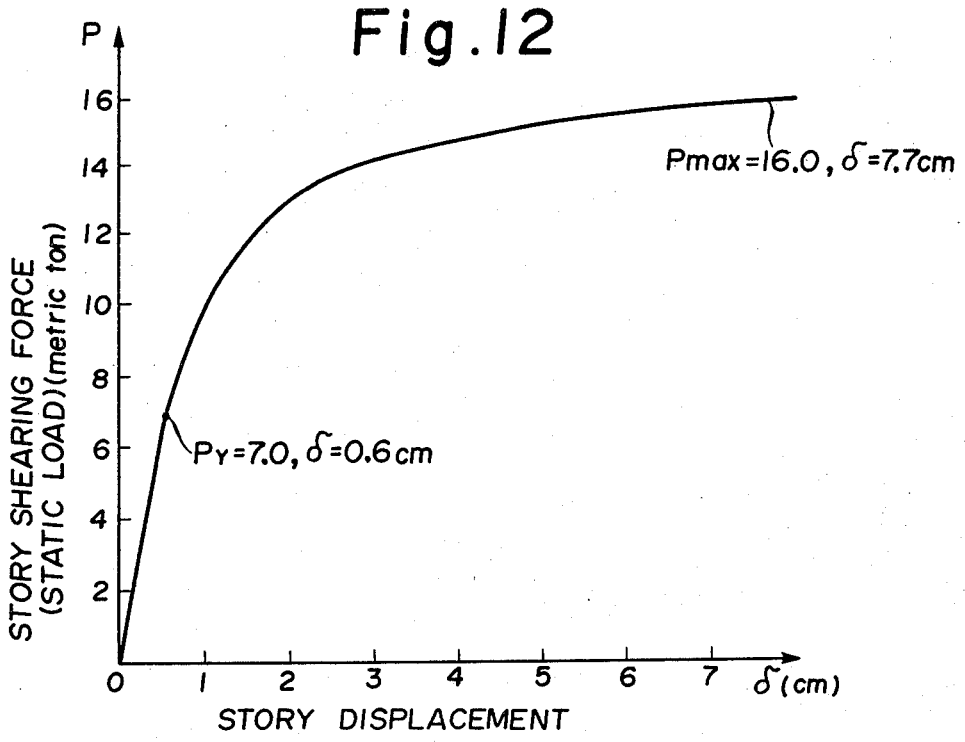
FIG. 12 is a graph illustrating the relation between story shearing forces applied to a two-story modular unit building with a building structure according to the present invention and story displacement thereof.

When ±8.0 metric tons ($\delta_H$/H−1/250) were applied, vertical cracks were produced at the corners of the wall ends. Diagonal cracks from top corners of the wall were noted in the outer face there of at ±12.6 metric tons ($\delta_H$/H=1/150). The bottom corners of the walls fractured and dropped at +14.8 metric tons. At the maximum strenth, all the PALC materials of the bottom portion of each wall fractured and dropped, and the brackets were largely deformed. The test was ended when one of the braces was broken at +16 metric tons. FIG. 12 illustrates the relation thus obtained between the horizontal shearing forces applied to the two story modular unit building and horizontal displacement thereof.

Another test was prepared and made on a bracket for the wall bottoms which was the type as shown in FIG. 3, and of which dimensions and material were the same as the above-mentioned bracket tested. In the test, the proximal end of the bracket was welded to the column as shown in FIG. 3 and alternative forces B (static loads) were applied to the free end portion of the bracket web 22 parpendicularly thereto. The forces were gradually increased from 3 to 8 metric tons by adding one metric ton after each hysteresis cycle. The following results were obtained:

| | |
|---|---|
| Proportional limit (a) | +3.0 (metric tons)<br>−4.0 |
| Displacement of the bracket free end at the proportional limit (δ) | +1.0 (mm)<br>−0.8 |
| Maximum strength ($p_{max}$) | +5.6 (metric tons)<br>−8.0 |
| Displacement of the bracket free end at the maximum strength | +16.4 (mm)<br>−12.0 |
| Maximum displacement of the bracket free end ($\delta_{max}$) | +16.5 (mm)<br>−12.2 |

Figure 13:
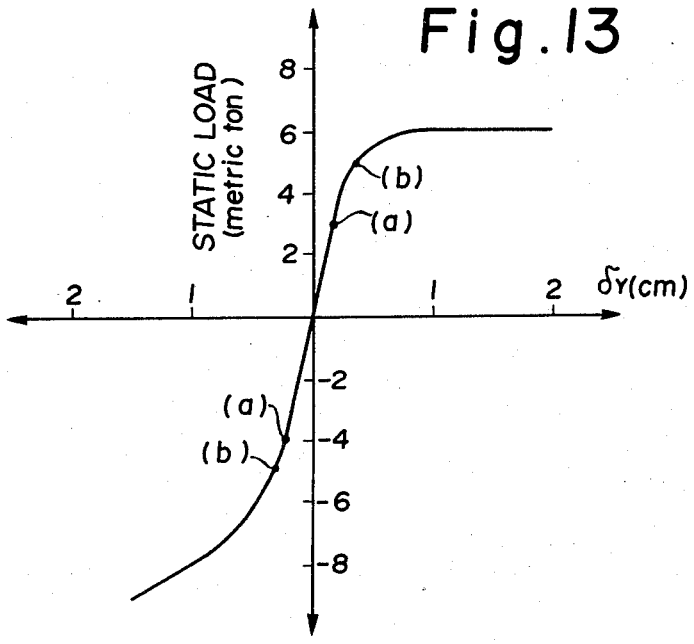
FIG. 13 is a graph illustrating the relation between forces applied perpendicularly to a bracket in FIG. 3 and displacement of the free end thereof.

The results are plotted in a graph in FIG. 13. At point (b) in the graph buckling of the bracket was noted.

While the invention has been disclosed with respect to one-story and two-story buildings, but it should be understood that the invention can be applied to more than two-story buildings, and the appended claims are intended to include within their meaning all modifications and changes that come within the true scope of the invention.

What is claimed is:

1. In a horizontal force resisting building structure wherein a bearing wall member having a structural core embedded therein is attached through attachments to a steel building framework so as to face a structure plane of the framework, the improvement wherein the attachments comprise:

(a) fastening means;

(b) a pair of upper plate brackets each firmly attached at its proximal end to the framework at a position such that distal ends of the upper plate brackets are fastened through the fastening means to the upper ends of the core; and (c) a pair of lower brackets each having a horizontal member, and a pair of vertical side plate members for supporting at their upper edges the lower face of the horizontal member, the side plate members each being firmly attached in a parallel manner at its proximal end to the framework at a position such that the horizontal member is fastened through the fastening means to the lower ends of the core;

the upper and lower brackets having less resistance to plastic deformation than the core; whereby the wall member is attached through only the four upper and lower brackets to the building framework.

2. The building structure as recited in claim 1, wherein each of the lower brackets is made of a channel member being firmly attached to the building framework with its channel directed perpendicular to the structural plane of the framework, whereby the horizontal member is a web of the channel member and the side plate members are legs integrally formed with the web.

3. The building structure as recited in claim 1, wherein the horizontal member is firmly attached at its lower face to the upper edges of the side plate members.

4. The building structure as recited in claims 2 or 3 wherein the upper brackets and the horizontal members of the lower brackets each have a slot formed therethrough to extend in parallel with the structural plane of the framework, and wherein the fastening means includes a bolt member passing through each of the slots and a nut member threadedly engaging with the bolt for fastening the core to the upper and lower brackets, whereby the bearing wall member is adjustable with respect to the framework.

5. The building structure as recited in claim 4, wherein the core is provided with a recess for receiving the distal end of the corresponding bracket, the distal end of the bracket being fastened to the recess by threadedly engaging the bolt member with the core embedded in the bearing wall members, and wherein the bracket projects from the framework perpendicularly to the structural plane thereof.

6. The building structure as recited in claim 5, wherein the nut member is firmly attached to the recess of the bearing wall member.

7. The building structure as recited in claim 1, which further includes a resilient body portion having a spring member which is generally of a hollow hexagonal prism shape having end plate portions respectively projecting from opposite sides of the body portion, said horizontal member of said lower bracket includes spaced leg portions on which said end plate portions rest, and wherein the fastening means includes a bolt member vertically and loosely passing through the center of the body portion and threadedly engaging with the structural core embedded in the bearing wall member to thereby resiliently fasten the body portion under compression to the bearing wall member.

* * * * *